US005774112A

United States Patent [19]

Kasson

[11] Patent Number: 5,774,112

[45] Date of Patent: Jun. 30, 1998

[54] METHOD AND APPARATUS FOR TONE CORRECTION OF A DIGITAL COLOR IMAGE WITH PRESERVATION OF THE CHROMATICITY OF THE IMAGE

[75] Inventor: James M. Kasson, Menlo Park, Calif.

[73] Assignee: International Business Machines Corporation, Armonk, N.Y.

[21] Appl. No.: 763,206

[22] Filed: Dec. 11, 1996

Related U.S. Application Data

[63] Continuation of Ser. No. 329,040, Oct. 25, 1994, abandoned.

[51] Int. Cl.[6] ..... G09G 5/04

[52] U.S. Cl. ..... 345/153; 345/147

[58] Field of Search ..... 345/147, 150, 345/153; 348/256, 675; 382/274

[56] References Cited

U.S. PATENT DOCUMENTS

| | | | |
|---|---|---|---|
| 2,634,324 | 4/1953 | Bedford | 348/675 |
| 4,464,667 | 8/1984 | Kuhn et al. . | |
| 4,752,821 | 6/1988 | Poetsch . | |
| 4,758,885 | 7/1988 | Saski et al. . | |
| 4,876,591 | 10/1989 | Muramatsu . | |
| 4,931,864 | 6/1990 | Kawamura et al. | 348/675 |
| 4,951,129 | 8/1990 | Lang et al. . | |
| 4,970,584 | 11/1990 | Sato et al. . | |
| 5,012,333 | 4/1991 | Lee et al. . | |
| 5,032,901 | 7/1991 | Vlahos et al. . | |
| 5,130,935 | 7/1992 | Takiguchi et al. . | |
| 5,146,346 | 9/1992 | Knoll et al. . | |
| 5,170,152 | 12/1992 | Taylor et al. . | |
| 5,237,402 | 8/1993 | Deshon et al. . | |
| 5,278,678 | 1/1994 | Harrington et al. . | |
| 5,283,670 | 2/1994 | Capitant et al. . | |
| 5,303,071 | 4/1994 | Kakimura et al. . | |
| 5,307,159 | 4/1994 | Hieda et al. . | |
| 5,315,416 | 5/1994 | Taniuchi et al. . | |
| 5,329,362 | 7/1994 | Takaiwa et al. . | |

OTHER PUBLICATIONS

Hunt, R.W.G., "The Reproduction of Colour In Photography, Printing & Television", pp. 595–597, Fountain press, Tolworth, England, 1987.

Omri Govrin, *Sharpening of Scanned Originals Using the Luminance, Hue and Saturation (LHS) Coordinate System,* SPIE vol. 2171, (Feb. 1994), pp. 332–338.

Gunter Wyszecki & W.S. Stiles, Color Science, *Concepts and Methods, Quantitative Data and Formulae,* John Wiley & Sons (1982) p. 487.

John C. Russ, *The Image Processing Handbook,* CRC Press (1992), pp. 1–6.

*Primary Examiner*—Jeffery Brier

*Attorney, Agent, or Firm*—Baker, Maxham, Jester & Meador

[57] ABSTRACT

Midtone correction of RGB pixel values is provided, without changes in chromaticity, by multiplying each color component of a linear RGB representation by a single value. The single value corresponds to an adjustment of the original luminance of the pixel, resulting in no change to the chromaticity of the pixel.

7 Claims, 5 Drawing Sheets

| Operation | Add | Multiplies | Table look-ups |
|---|---|---|---|
| Linearize | | | 3 |
| Compute luminance | 2 | 3 | |
| Compute ratio | | | 1 |
| Multiply by ratio | | 3 | |
| Nonlinearize | | | 3 |
| Total | 2 | 6 | 7 |

METHOD AND APPARATUS FOR TONE CORRECTION OF A DIGITAL COLOR IMAGE WITH PRESERVATION OF THE CHROMATICITY OF THE IMAGE

This application is a continuation of application Ser. No. 08/329,040, filed on Oct. 25, 1994, now abandoned.

BACKGROUND OF THE INVENTION

FIELD OF THE INVENTION

This invention relates to a method and a means for correcting color tone in color images without changing chromaticity. More specifically, the method embraces the control of pixel midtone values that produces chromatically-correct results.

A desirable function of an image editing system is the ability to control midtone values of image pixels without affecting the white and black points of the image or the chromatic appearance of the image midtones.

The standard method for control of midtone values is through the adjustment of gamma (γ), an exponential constant that is used to adjust the color intensity of an input pixel in order to obtain a desired intensity for an output pixel. The transformation from input to output pixel intensity can be plotted as a curve that rises from a low (preferably, 0) value for black to a high value for white. Typically, in digital systems, the transform curve is normalized between 0 (black) and 1 (white), with intensity values being represented by an 8-bit number having 256 distinct values in the range [0,1]. When gamma has a value of 1.0, the transform from input to output light intensity is linear; when gamma is greater or less than 1.0, respective portions of the range of output values are expanded or compressed. See Russ's work entitled "The Image Processing Handbook", CRC Press, 1992 (pp. 6–11).

Physically, gamma can be thought of as the power to which an electron beam current is raised in order to cause a phosphor on a computer monitor to emit light of a desired intensity. In tricolor systems such as the RGB (red green blue) system, the screen portion of a computer monitor has three different phosphors, each for emitting a respective one of the three primary colors (R, G, or B) and each independently excited by the electron beam. Because the three phosphors respond to the same electron beam by emitting different intensities of their respective primary colors, gamma adjustment varies the chromaticity of perceived color.

Gamma adjustment is most commonly used in RGB image editing for midtone brightness control. In this regard, an image editor may embody an executable process in a computer system or an application specific integrated circuit (ASIC) that operates to process pictures displayed on a computer monitor. Typically, an image editor provides an interactive interface that enables the user of the computer system to designate and adjust the values of color attributes of an image for processing. Prior art image editors enable an operator to select white and black points and to adjust the midtone values between the black and white points using controls that change gamma correction for computer monitors with different nonlinearities.

An image editor that processes an RGB image typically operates on a buffered array of pixels that represents the image. Each pixel includes R, G, and B components and the image buffer is partitioned into three parts, each buffer part being referred to as a "color plane". Each color plane buffers respective R, G, or B components of the pixels in the array of pixels. An image editor adjusts image gamma by subjecting each color plane of pixels in the image to the following operation, for an image whose pixel intensity values are scaled into the range [0,1]:

$$R_{out}=R_{in}^{\gamma}$$

$$G_{out}=G_{in}^{\gamma}$$

$$B_{out}=B_{in}^{\gamma}$$

Since 0 raised to any power of gamma equals 0 and 1 raised to any power of gamma equals 1, the function of equation (1) does not affect either the black point or the white point. Most image editors make it possible to pick different gammas for each color plane and to construct nonlinearities other than power laws, but they provide midtone controls that independently subject each color plane to a nonlinearity. When performed in a nonlinear RGB color space, for the purpose of modifying midtone values rather correcting for a specific monitor, this kind of operation causes an unwanted side effect: the chromaticities of the pixels are altered when gamma is changed.

One conceptually simple, but possibly computationally prohibitive, solution exists for avoiding unwanted chromaticity changes. This solution converts an image from RGB color space to a true luminance-chrominance color space, manipulates only the luminance by subjecting it to a nonlinearity, then converts the results back to the RGB color space. There are a number of color spaces in which luminance is a primary component. One such system is the YIQ scheme in which Y represents the luminance ("brightness") of a pixel. In this regard, Y can be obtained from the RGB components of a pixel by combining them in predetermined proportions. Unfortunately, the I and Q components do not encode chromaticity only and, therefore, operations YIQ change the chromaticity of the adjusted RGB intensity values. Conversion to a true luminance-chrominance space such as CIELAB would produce better results but the cost of conversion to CIELAB and back to RGB is expensive.

SUMMARY OF THE INVENTION

Accordingly, it is an objective of this invention to provide mid-tone correction of image colors by changing only luminance, with no changes in chromaticity.

Another object of the invention is to perform an adjustment of image luminance in a computationally efficient manner.

A further objective of the invention is to achieve such computational efficiency by avoiding conversion from one color space to another.

The invention, which achieves these and other significant objectives and advantages, is based upon the inventor's critical realizations that the linear RGB triplets describing the pixels of an image can be linearly changed by a single value representing luminance without changing the chromaticity of the image, and the mapping to output luminance should be controlled by the input luminance of the image.

DETAILED DESCRIPTION OF THE PREFERRED EMBODIMENT

In the description which follows, reference will be made to the CIE chromaticity scheme for defining colors. This scheme uses the well-known CIE chromaticity diagram having two dimensions (x and y) that define the chromaticity of a color and a third dimension, Y, that establishes color brightness. Therefore, any color can be defined according to the CIE diagram by a triplet (Yxy). Each component of the triplet may be assigned a value on the CIE diagram and the values are combined to yield the color. Relatedly, according to the CIE scheme, reference may be made to the xy chromaticity of the pixel and to the Y luminance of the pixel.

Figures 1, 2:
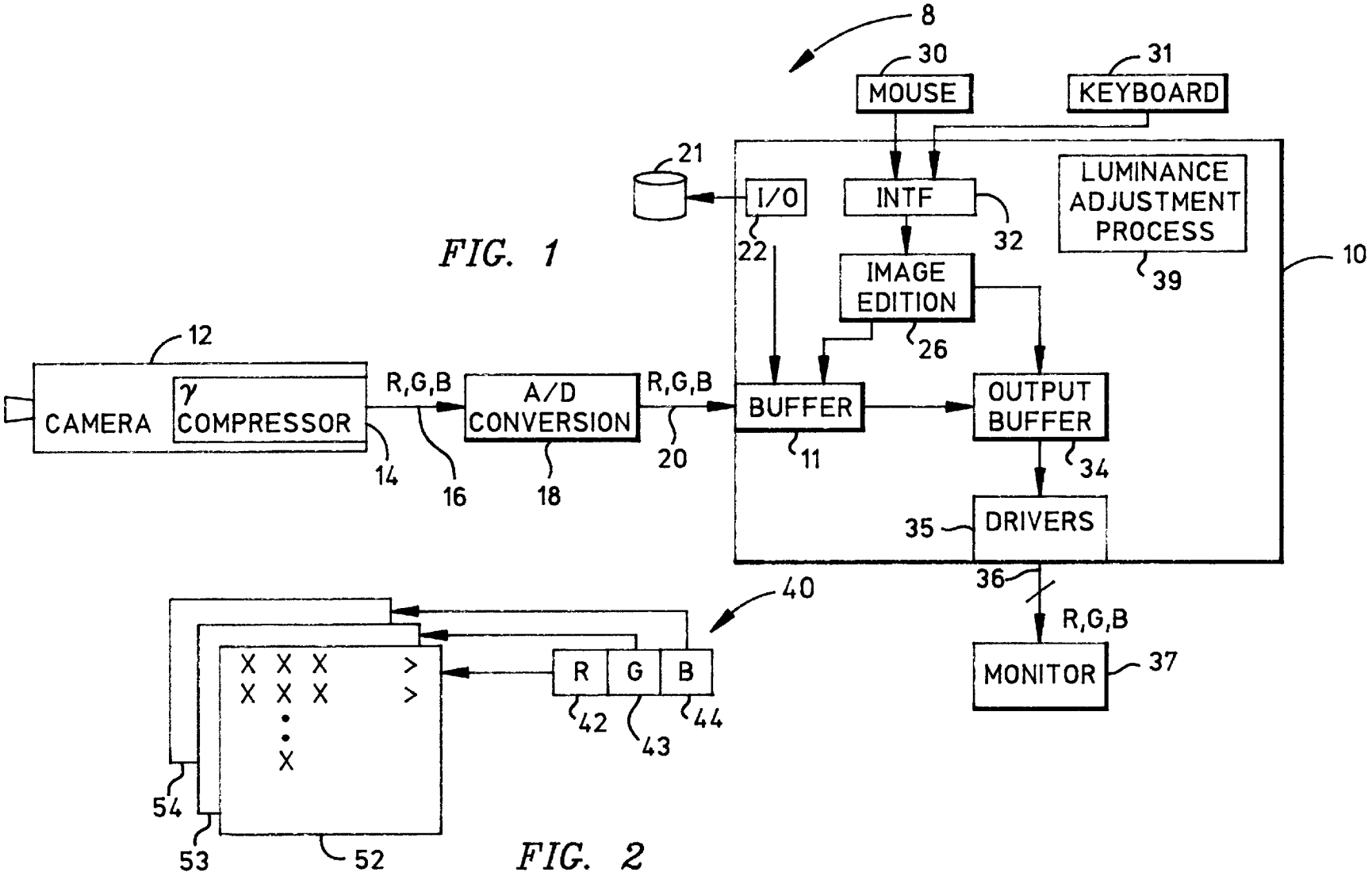
FIG. 1 is block diagram illustrating a representative application environment in which the invention is practiced.
FIG. 2 is a block diagram representing the structure of a buffer that temporarily stores an array of pixels representing an image in which each pixel is partitioned into three color components, each color component having a value representing the magnitude of a primary color.

Refer now to the drawings wherein like reference numerals designate like or similar parts throughout the several illustrations. In FIG. 1, a physical context for practicing the invention is illustrated. In FIG. 1, an image editing system includes a computer 10, preferably a general-purpose personal computer. Although not shown, the structure of the computer 10 includes one or more processors, random access memory (RAM), large-capacity direct access memory, and a high-resolution color-graphics process. An input image buffer 11 is provided in the RAM of the computer 10 for storage of a two-dimensional array of pixels representing a color image. The input image buffer 11 may receive its contents from a variety of means. One such means includes a three-color camera 12 including a γ compressor 14. The camera 12 operates conventionally to produce a scanned array of analog pixels, each provided on an output signal path 16 with respective R, G, and B components. The pixel analog values are converted by an analog-to-digital A/D converter 18. The A/D converter 18 provides the stream of pixels as a sequence of digital words, each having 3 eight-bit numbers representing the magnitudes of the R, G, and B components of a pixel, respectively. The sequence of pixels is assembled, using standard techniques and means, in the input image buffer 11 as a two-dimensional pixel array that represents an image.

An alternate means for providing a pixel array to the buffer 11 is the direct access storage device (DASD) 21 in which a database of images can be stored and retrieved through an input-output (I/O) process 22.

An image editor 26 is provided as a process executable by the computer 10. In this regard, the image editor 26 may be in the form of a software product comprising a sequence of instructions that define functions that the image editor is to execute, workspace contents resident in the RAM of the computer 10, and one or more process control structures. Alternatively, the image editor 26 may comprise application-specific integrated circuitry (ASIC) embodying customized logic and other resources that execute the functions of the image editor.

In whatever form, the image editor 26 processes images by operating on pixel arrays in the input image buffer 11, and transferring processed pixel arrays to an output image buffer 34 in the RAM of the computer 10. The pixels in the output image buffer 34 are conventionally fed to monitor drivers 35 which produce, on signal line 36, the R, G, and B analog signals necessary to drive a high-resolution video monitor 37.

An interactive interface to the image editor 26 is afforded by way of user-manipulated input devices such as a mouse 30 and keyboard 31 that are connected to the image editor 26 by way of a standard peripheral interface 32.

The invention, embodied as a luminance adjustment process 39, forms a portion of the image editor 26 either as a routine that an image editor process invokes or as a subset of ASIC logic embodying an image editor.

The mouse 30 and keyboard 31 are used conventionally to provide inputs to the image editor 26 that represent the blackpoint and whitepoint of color intensity, as well as a selectable value for γ.

FIG. 2 illustrates the conventional structure of an image buffer that contains a two-dimensional array of pixels in the form of digital words. One such word is indicated by reference numeral 40 and includes 3 eight-bit digital values representing the intensity of, respectively, the R component 42, the G component 43, and the B component 44 of the pixel. In an image buffer, the pixel values are arrayed two-dimensionally in respective buffer portions or planes. In FIG. 2, R values are stored in pixel array form in a buffer portion for the R plane 52. Similarly, G and B components are stored in two-dimensional array form in G and B planes 53 and 54, respectively.

THE INVENTION

The invention provides a midtone correction transformation that changes the luminance of pixels with no change in chromaticity. Implied in this formulation is a color space with a chromaticity representation. The inventor takes the xy chromaticity of the CIE color representation scheme as a standard representation for the purpose of explaining the invention. In this regard, the effect of raising the luminance of part of an image corresponds to shining light onto that part. The parallel is not perfect, since the operations of the invention are all point-processes; that is, they operate on each pixel without consideration of any other pixel in the image. Nevertheless, the point is well-illustrated if an image is thought of as consisting of a group of solid-color patches. Raising the luminance of any one patch would be correctly performed if it were possible to shine more light on that patch, and lowering the luminance of any one patch would be correctly performed if it were possible to reduce the amount of light shining on that patch in the original scene. As is shown hereinafter, changing the luminance of a putative light source does not change the xy chromaticity of a thereby illuminated object in an image.

Consider a surface color illuminated by an illuminant $I(\lambda)$. If the reflectivity of the s $Ref(\lambda)$, the spectrum of the reflected light is $O(\lambda)=I(\lambda)Ref(\lambda)$. To convert the spectrum of the reflected light into a linear RGB color space, the wavelength-by wavelength product of the reflection spectrum is completed with a set of color-matching functions $r(\lambda)$, $g(\lambda)$, and $b(\lambda)$ as follows:

$$R=\int_{-\infty}^{\infty} 0(\lambda)r(\lambda)d\lambda=\int_{-\infty}^{\infty} I(\lambda)Ref(\lambda)r(\lambda)d\lambda \tag{2}$$

$$G=\int_{-\infty}^{\infty} 0(\lambda)g(\lambda)d\lambda=\int_{-\infty}^{\infty} I(\lambda)Ref(\lambda)g(\lambda)d\lambda$$

$$B=\int_{-\infty}^{\infty} 0(\lambda)b(\lambda)d\lambda=\int_{-\infty}^{\infty} I(\lambda)Ref(\lambda)b(\lambda)d\lambda$$

Say an object with is illuminated by a source with spectrum $I_1(\gamma)$. When encoded into an arbitrary RGB color space, the results are:

$$R_1=\int_{-\infty}^{\infty} I_1(\gamma)Ref(\gamma)r(\gamma)d\gamma \tag{3}$$

$$G_1=\int_{-\infty}^{\infty} I_1(\gamma)Ref(\gamma)g(\gamma)d\gamma$$

$$B_1=\int_{-\infty}^{\infty} I_1(\gamma)Ref(\gamma)b(\gamma)d\gamma$$

Now, say the illuminant's intensity is changed so that it is 4 times as bright as before. The new illuminant $I_2(\gamma)$ has the spectrum:

$$I_2(\gamma)=\alpha I_1(\gamma) \tag{4}$$

When encoded in the same RGB color space as above:

$$R_2=\int_{-\infty}^{\infty} \alpha I_1(\gamma)Ref(\gamma)r(\gamma)d\gamma=\alpha R_1 \tag{5}$$

$$G_2=\int_{-\infty}^{\infty} \alpha I_1(\gamma)Ref(\gamma)g(\gamma)d\gamma=\alpha G_1$$

$$B_2=\int_{-\infty}^{\infty} \alpha I_1(\gamma)Ref(\gamma)b(\gamma)d\gamma=\alpha B_1$$

In words, increasing the illuminant to $\alpha$ times its previous value causes each component of a linear RGB representation to be multiplied by $\alpha$. Thus, it is not necessary to use a luminance-chrominance color space in the algorithm; all that is required is to linearly increase the value of each component of the linear RGB triplet describing each pixel by an amount that depends on the original luminance of the pixel. This processing will not change the xy chromaticity of the pixel, since multiplying each component of a linear RGB color by a constant $\alpha$ causes XYZ representation to be multiplied by the same constant. If $$\begin{bmatrix} X_1 \\ Y_1 \\ Z_1 \end{bmatrix}=M\begin{bmatrix} R_1 \\ G_1 \\ B_1 \end{bmatrix} \tag{6}$$

then

-continued $$\begin{bmatrix} X_2 \\ Y_2 \\ Z_2 \end{bmatrix}=M\begin{bmatrix} \alpha R_1 \\ \alpha G_1 \\ \alpha B_1 \end{bmatrix}=\alpha M\begin{bmatrix} R_1 \\ G_1 \\ B_1 \end{bmatrix}=\alpha\begin{bmatrix} X_1 \\ Y_1 \\ Z_1 \end{bmatrix}=\begin{bmatrix} \alpha X_1 \\ \alpha Y_1 \\ \alpha Z_1 \end{bmatrix} \tag{7}$$

and thus $$x_2=\frac{X_2}{X_2+Y_2+Z_2}=\frac{\alpha X_1}{\alpha X_1+\alpha Y_1+\alpha Z_1}=\frac{X_1}{X_1+Y_1+Z_1}=x_1 \tag{8}$$

$$y_2=\frac{Y_2}{X_2+Y_2+Z_2}=\frac{\alpha Y_1}{\alpha X_1+\alpha Y_1+\alpha Z_1}=\frac{Y_1}{X_1+Y_1+Z_1}=y_1$$

Figures 3A, 3B:
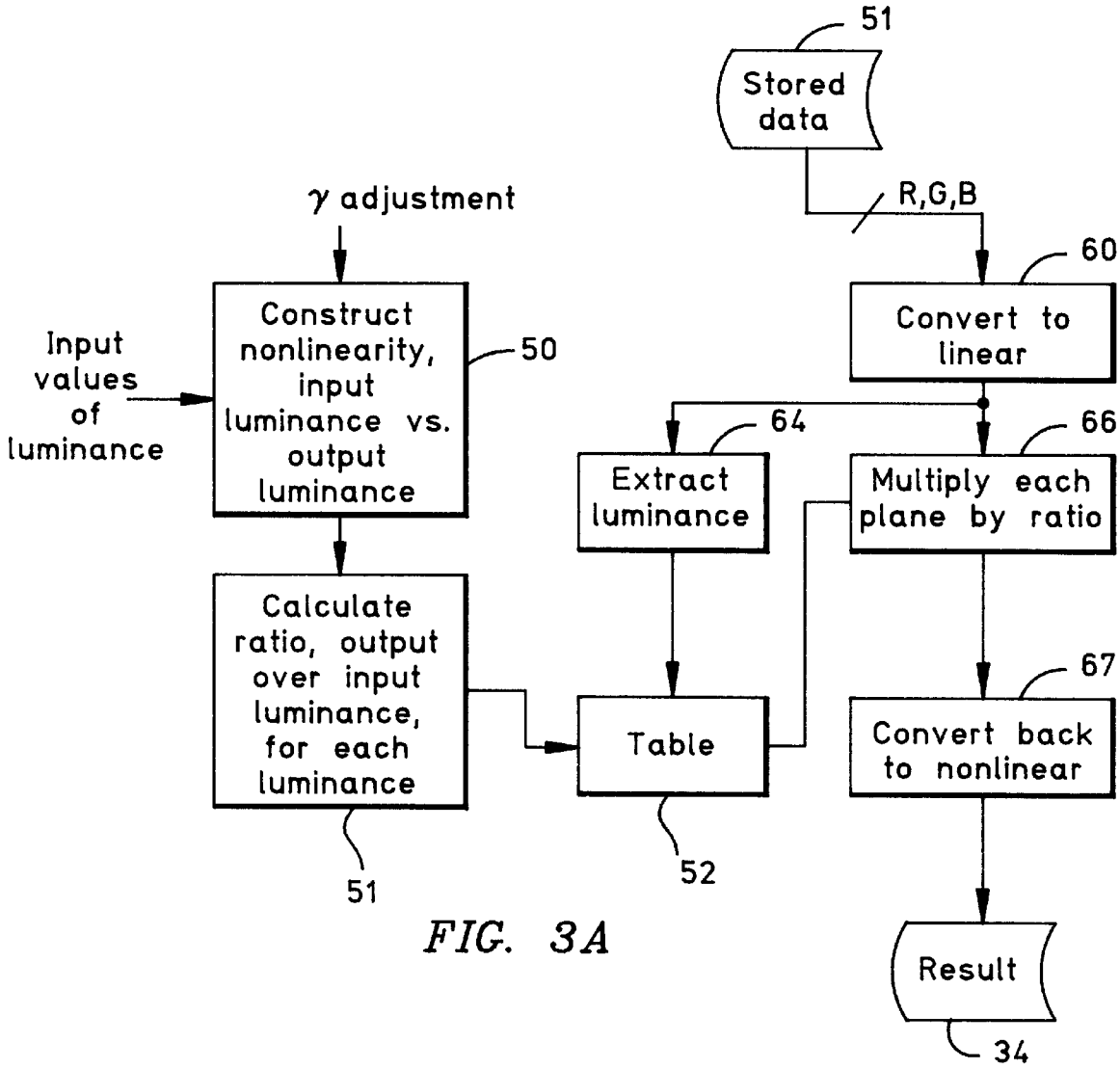
FIG. 3A is a combination block and flow diagram representing a process and a method for midtone correction of RGB images according to the invention which preserves chromaticity and does not require color space conversion.
FIG. 3B is a table representing the computational costs of the process of FIG. 3A.

The process illustrated in FIG. 3A meets the objectives. In FIG. 3A, the invention is presented in the form of a process flow diagram comprising elements 50, 51, 52, 60, 64, 66, and 67. Those skilled in the art will realize that these elements precisely define both a circuit and a process for practicing the invention. Initially assume that some change for adjustment to midtones of an image is input to the process. This could, for example, take the form of a change to the value of $\gamma$. Knowing the range of possible values to which luminance is confined, the process, in process element 50, constructs a non-linearity by, say, raising each possible value in the input luminance range to a power represented by the new value of $\gamma$. Next, in process element 51, the process obtains a ratio for each possible value in the range of input luminance wherein the ratio is the value of output luminance to the value of input luminance, the value of output luminance being the value of input luminance raised to the new value of $\gamma$. The results of process elements 50 and 51 are tabularized in a table that is indexed by input luminance values. Each entry in the table maps the input luminance value to the ratio calculated for that value in process elements 50 and 51. Process element 52 represents completion of the table. Next, an image in the form of an array of pixels is provided from the input image buffer and processed according to the invention to adjust its midtone values using the table built in process element 52. In this regard, the pixels of the array are processed one-by-one, in array order by process elements 60, 64, 66, and 67. Recalling that each pixel includes an R, G, B triplet, the color component values of a pixel are linearized in process element 60. Using the linearized values of the RGB components of the pixel, luminance is extracted for the pixel according to the CIE relationship, the luminance value is used to index to an entry in the table and the corresponding ratio stored in the table for the extracted luminance value multiplies the linearized digital values for the R, G, and B components of the pixel in process element 66. Manifestly, each color component of the pixel is changed by the same proportion as the other two color components, resulting in adjustment of the luminance of the pixel, without any corresponding change in its chromaticity. The pixel values are then converted in process element 67 to their standard non-linear form and the pixel is stored in its proper array location in the output image buffer 34.

FIG. 3B illustrates the computational costs per pixel of a straightforward implementation of the process illustrated in FIG. 3A.

It is possible to improve the computational efficiency of the invention, without sacrificing accuracy. One improvement may be realized by performing the multiplications inherent in FIG. 3A directly on $\gamma$-corrected RGB values, instead of first linearizing. This improvement provides results which are equivalent to those achieved by the process of FIG. 3A because:

$$kr' = kr^{\gamma} = (k^{\frac{1}{\gamma}} r)^{\gamma} \quad (9)$$

$$kg' = kg^{\gamma} = (k^{\frac{1}{\gamma}} g)^{\gamma}$$

$$kb' = kb^{\gamma} = (k^{\frac{1}{\gamma}} b)^{\gamma}$$

or, stated another way:

$$K^{\gamma}r' = k^{\gamma}r^{\gamma} = (kr)^{\gamma}$$

$$K^{\gamma}g' = k^{\gamma}g^{\gamma} = (kg)^{\gamma} \quad (10)$$

$$K^{\gamma}g' = k^{\gamma}b^{\gamma} = (kb)^{\gamma}$$

Therefore multiplying a linear representation by a constant, say k, and then raising it to the power γ, produces the same results as multiplying a γ-corrected representation by a different constant k, raised to the γ power. So, the process of FIG. 3A can be modified by performing a gamma correction on the ratios entered in the table in process element 52 and linearization of values can be limited to the R, G, B component values input into the luminance calculation of process element 64. No linearization would be required at the input to process element 66 and no conversion back to nonlinear reform would be required at its output. However, the nonlinearity which is constructed in implementing equation (10) is the nonlinearity calculated in process element 50, raised to the power of γ for the input image. This approach saves the three table lookups required to convert the output of process element 66 back to the nonlinear form.

The inventor has realized that approximations to the approach illustrated in FIG. 3A can be implemented which result in higher computational efficiency, with very little change in results. For example, the luminance calculation of process element 64 can be simplified by employing an approximation to luminance computed from gamma-corrected RGB signals, which requires only additions and multiplications. For example, a useful approximation is afforded by the luminance Y' defined by the well-known NTSC standard:

$$Y' = 0.2999R' + 0.587G + 0.114B' \quad (11)$$

where the primes indicate the gamma-corrected values. (Those skilled in the art will appreciate that NTSC luminance Y' is not the CIE luminance Y discussed above.) In equation (11), the prime is usually dropped from the Y' designator. This approximation to luminance is accurate along the gray scale, and shows increasing errors only as colors become more saturated. Use of this approximation instead of direct computation of luminance as shown in FIG. 3A eliminates the three table lookups involved in linearizing the data and the process is simplified to the form illustrated in FIGS. 4–6.

Figure 4:
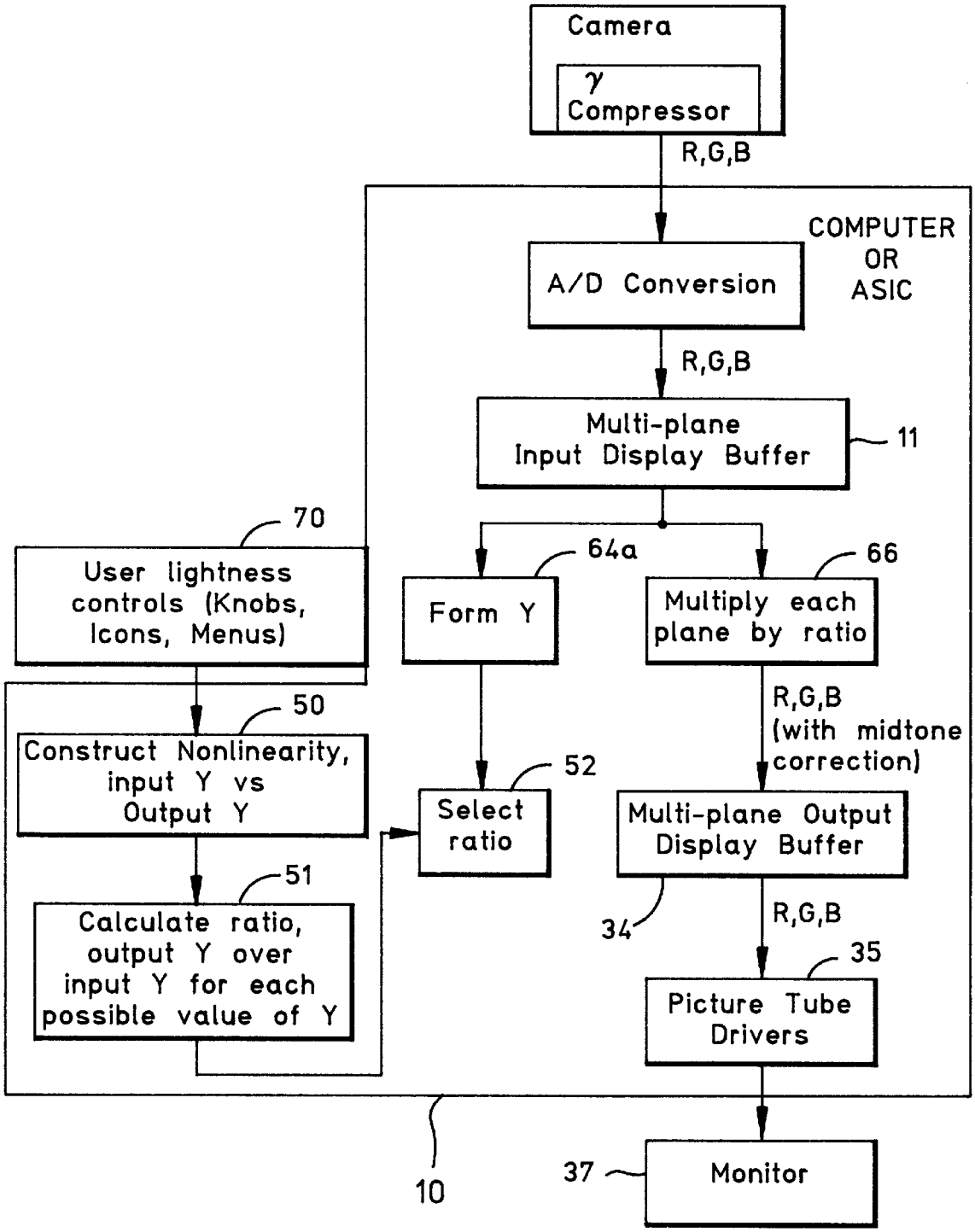
FIG. 4 illustrates a midtone correction process using an NTSC approximation to luminance.

In FIG. 4, the process of FIG. 3A has been altered by substitution of process element 64*a* for 64 of the previous figure. In addition, user controls for inputting various luminance values are indicated by reference numeral 70. FIG. 4 shows an embodiment of the invention in which the NTSC luminance Y is used to approximate the luminance calculation. This is represented by process element 64*a*. For completeness, the embodiment is illustrated together with the drivers 35 and the monitor 37.

Figure 5:
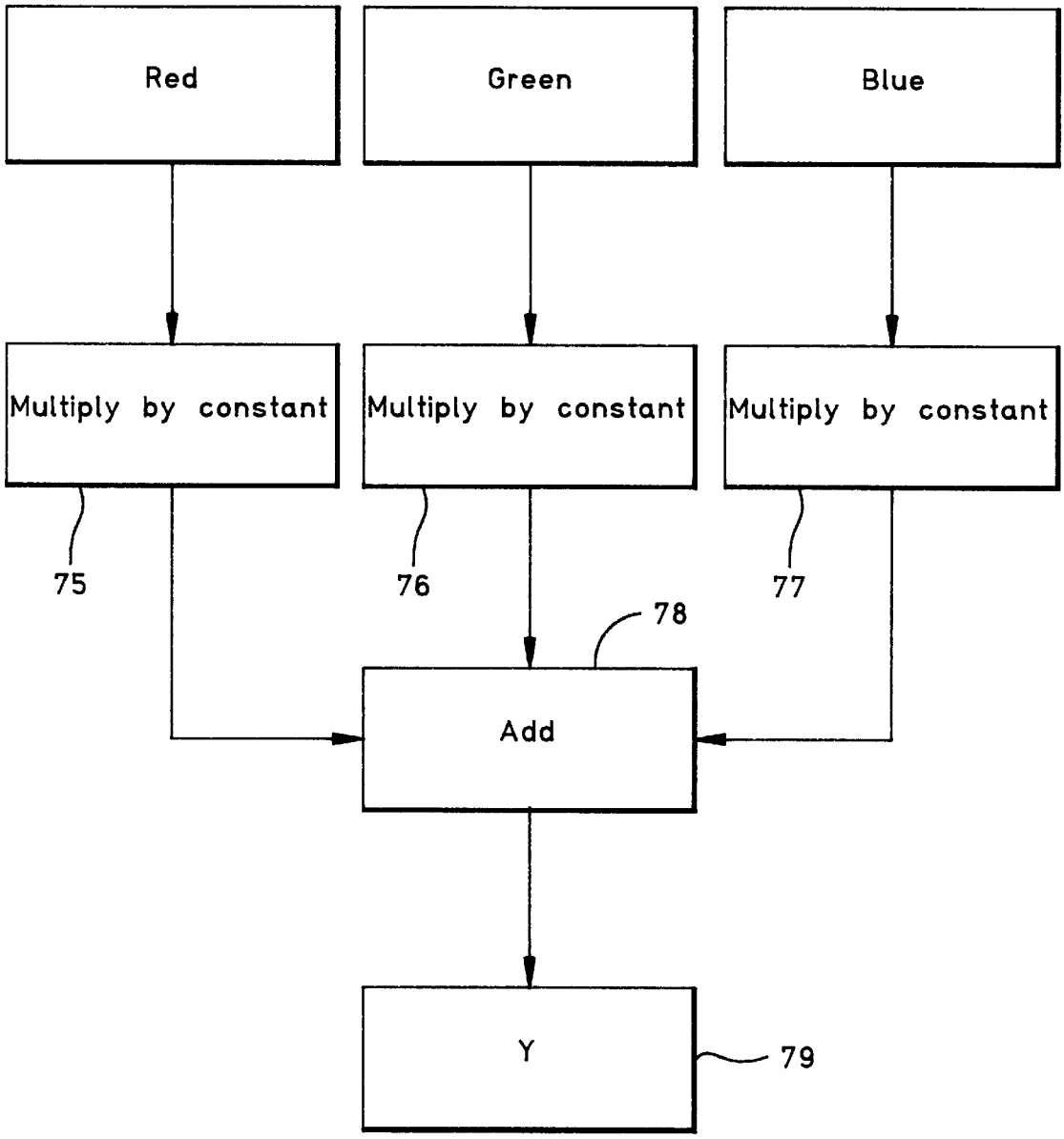
FIG. 5 is a block diagram illustrating the formation of an approximate luminance value for a use in the process of FIG. 4.

The element 64*a* of the process illustrated in FIG. 4 is shown in more detail in FIG. 5. In FIG. 5, the red, green, and blue component values are multiplied by the respective constants of equation (11) in multipliers 75, 76, and 77, respectively. The outputs of the multipliers 75, 76, and 77 are provided to a two-stage adder 78. The sum produced by the adder 78 is registered for one pixel period at 79. The contents of the register 79 address the ratios stored in the table assembled in process element 52. The three color planes are then multiplied by the ratio for the current pixel and three separate multipliers embodied in process element 66 and the results are stored in the output display buffer 34. When processing according to the invention is completed, the array of pixels stored in the output display buffer 34 is fed pixel-by-pixel to the picture tube driver 35 for display of a corresponding image on the high-resolution monitor 37.

Figure 6:
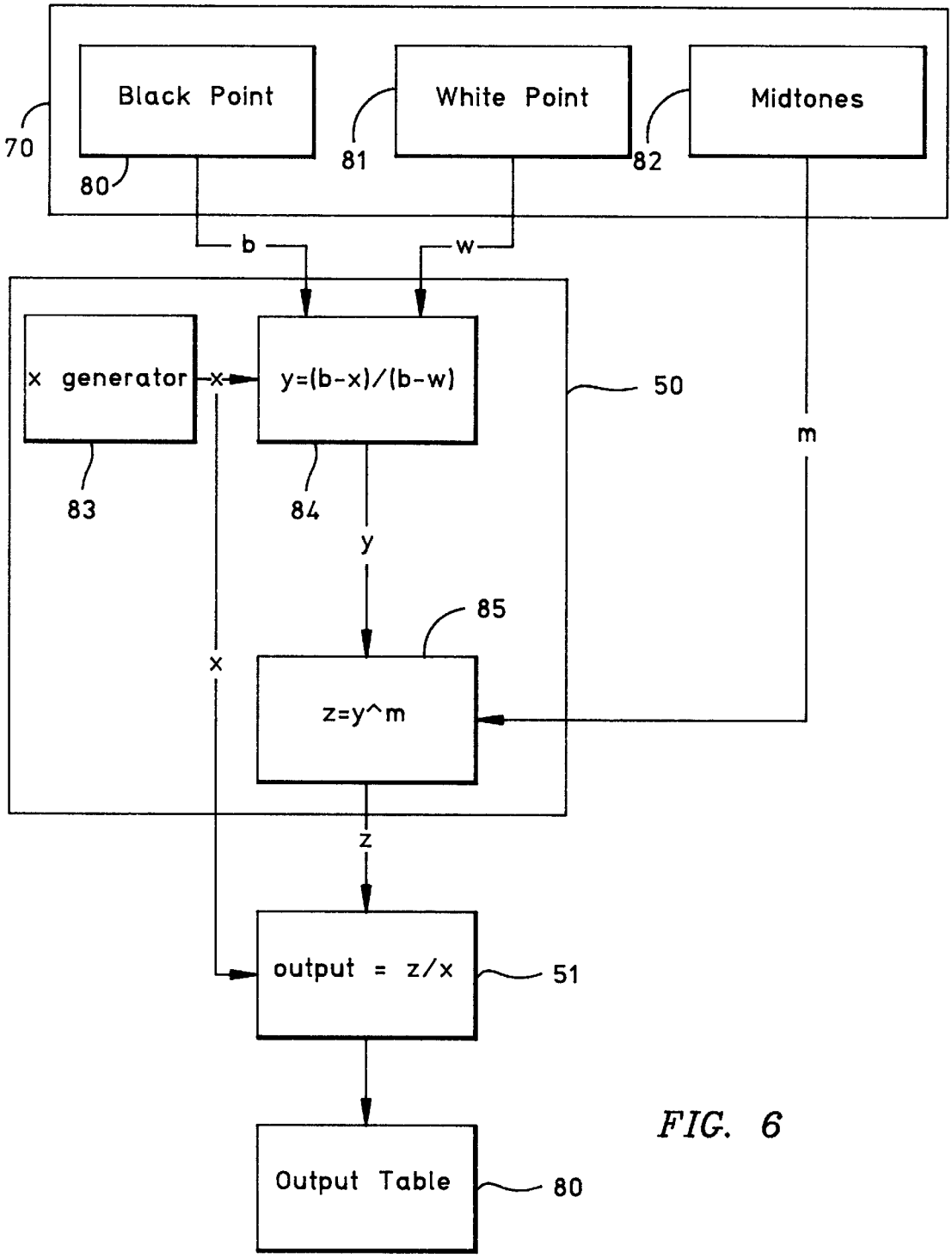
FIG. 6 is a block diagram illustrating a portion of the process of FIG. 4 that provides, for every possible value of input luminance, the ratio which that value bears to a corresponding value of output luminance.

The contents of the table used in process element 52 are generated by logic represented by the process elements illustrated in FIG. 6. In FIG. 6, the user lightness controls 70 include a black point value generator 80 that generates a value b establishing a blackpoint value below which all input intensity values map to an output value of zero (black). In addition, the user lightness controls include a whitepoint value mechanism 81 for establishing a value w above which all input intensity values map to output intensity values that correspond to white; of course, in a normalized output transform, this value is 1. Last, a midtone adjustment mechanism 82 is manipulated by a user to provide a value m by which luminance is to be adjusted, for example, for midtone correction between the black and white point values b and w. This value m can, for example, be a value for γ.

The non-linearity mapping input luminance to output luminance (process element 50 of FIG. 3A) is implemented by an x generator 83, translation logic 84, and nonlinearity logic 85. In this regard, the x generator 83 generates all possible 254 values for intensity in the input range [01]. These values which are represented by x in FIG. 6, are fed to the logic 84. The logic 84 calculates a linear luminance relationship y between the established black and white points b and w. The linear relationship y is provided to the non-lineary circuit 85, which transforms each value of y to a corresponding output luminance value according to the relationship $z=y^m$. This value z is provided to logic that implements process element 51 according to the mathematical relationship w=z/x. Thus, for each possible value in a range of input luminance values generated by the x generator 83, a ratio, w, is calculated by the logic implementing process element 51, the ratio representing the division of the corresponding output luminance value, z by an input luminance value y. All values of w are entered into a table 80. Each value of w is indexed by a respective value in the range of possible values for input luminance. Thus, when a value of Y is formed (64*a* in FIG. 4), the value indexes to a respective ratio in the table 80 (step 52 in FIG. 4) and the ratio is used to multiply the R, G, B values for the current pixel at block 66. This simplification means that the computational costs per pixel includes two adds (to compute luminance), six multiplies (three to complete luminance and three to multiply each color component of the current pixel), and one table lookup at process element 52.

With reference to the fact that the luminance computation still forms a large portion of the total computational cost, Y can further be approximated by employing coefficients that are powers of two and using shifts to avoid actual multiplication. This may be implemented in logic as follows:

$$Y' = 0.25r' + 0.625g' + 0.125b'$$

$$Y' = 0.25r' + 0.5g' + 0.125g' + 0.25b' \quad (12)$$

For each pixel, these approximations require three adds and four shifts to calculate Y, three multiplies in process element 66, and one table lookup in process element 52. Other more approximate simplifications of Y are:

$$Y'=0.25r'+0.75g'$$

$$Y'=0.25r'+0.25g'+0.5g' \quad (13)$$

For each pixel, these approximations require two adds and three shifts to compute luminance, three multiplies for midtone correction, and one table lookup. The simplest approximation to Y is:

$$Y=g' \quad (14)$$

For each pixel, this approximation costs three multiplies for midtone correction and one table lookup.

If, as is the case in most hardware implementations, multiplies are cheaper than one-dimensional table look-ups, the algorithm of equation (14) is less computationally complex than the others described above.

The following table summarizes CIELAB chromaticity errors for the embodiment of the invention that approximates luminance. The errors were measured in $\Delta E_{ab}$.

| Equation | Average | Maximum |
|---|---|---|
| (11) | 0.8 | 6.9 |
| (12) | 1.0 | 6.0 |
| (13) | 1.3 | 6.1 |
| (14) | 4.0 | 21.9 |

Assuming that a shift implemented in integrated circuitry costs half an add, that a multiply costs four times an add, and that a table lookup costs eight times an add, the various embodiments presented hereinabove have the following costs:

| | Standard | Linear L | Non-linear L | eg (11) | eg (12) | eg (13) | eg (14) |
|---|---|---|---|---|---|---|---|
| Adds | | 2 | 2 | 2 | 3 | 2 | |
| Multiplies | | 6 | 6 | 6 | 3 | 3 | 3 |
| Table Lookups | 3 | 7 | 4 | 1 | 1 | 1 | 1 |
| Shifts | | | | | 4 | 3 | |
| Equivalent Adds | 24 | 82 | 58 | 34 | 25 | 23.5 | 20 |

Manifestly, the embodiments that approximate luminance are very efficient from a computational point of view. However, as the two tables illustrate, the tradeoff for lower costs is increased chromaticity error.

One significant design consideration to be taken into account when the invention is implemented is the effect on chromaticity of remapping the blackpoint and whitepoint of an image. Relatedly, remapping occurs when an operator selects the white and black points in response to which each color plane in the image is subjected to the following operation, for an image scaled into the range [0,1]:

$$R_{out}=(b-R_{in})/(b-w)$$

$$G_{out}=(b-G_{in})/(b-w) \quad (15)$$

$$B_{out}=(b-B_{in})/(b-w)$$

Changing the blackpoint in this way causes an unwanted side effect by altering pixel chromaticities. The nature of the alteration is neither simple nor easy to predict, and is dependent on the primaries and nonlinearities of the RGB color space selected for image manipulation. However, the inventor has realized that the alteration of pixel chromaticity can be substantially reduced in the embodiment of the invention illustrated in FIG. 3A by implementing the non-linearity relationship of equation (15) in the logic that implements process element 67.

Clearly, other embodiments and modifications of the present invention will occur readily to those of ordinary skill in the art in view of these teachings. Therefore, this invention is to be limited only by the following claims, which include all such embodiments and modifications.

I claim:

1. An apparatus for modifying colors of pixels in pixel array that represents a color image, comprising:

a source of a pixel array, each pixel in the pixel array including a plurality of color components, each color component representing a respective component of a color space and having a value representing the contribution of the component to a color which the pixel has;

means for providing an adjusted single color attribute value in response to a user-selected selected value, attribute means coupled to the source for obtaining a single color attribute value for a pixel by combining the values of the pixel's color components;

attribute adjustment means coupled to the attribute means for adjusting the single color attribute value to the adjusted single color attribute value;

color adjustment means coupled to the attribute adjustment means for adjusting the color of the pixel by changing the values of the pixel's color components in response to the adjusted single color attribute value; and a monitor drive connected to the color adjustment means for producing a monitor drive signal to cause a monitor to display the pixel in response to the pixel's color components.

2. The apparatus of claim 1, wherein the single color attribute value is a value of the pixel's luminance.

3. The apparatus of claim 2, wherein the color space is RGB (red, green, blue) color space, and the color components are, respectively, red, green, and blue components.

4. The apparatus of claim 3, wherein the pixel's luminance (Y) is given by:

$$Y'=0.2999R'+0.587G'+0.114B'.$$

5. The apparatus of claim 2, wherein the attribute adjustment means includes:

means for providing for each possible value of the pixel's luminance, an adjusted value, and means for providing a ratio of each adjusted value to a corresponding value of the pixel's luminance;

wherein the color adjustment means changes the values of the pixel's color components by multiplying each value of the pixel's color components by a ratio of an adjusted value to the value of the pixel's luminance.

6. The apparatus of claim 5, wherein the means for providing a ratio includes a table of adjusted values indexed by all possible values of the pixel's luminance.

7. The apparatus of claim 6, wherein the color space is RGB (red, green, blue) color space, and the color components are, respectively, red, green, and blue components.

* * * * *